US010968913B2

(12) United States Patent
Scharer et al.

(10) Patent No.: US 10,968,913 B2
(45) Date of Patent: Apr. 6, 2021

(54) REFRIGERANT COMPRESSOR SYSTEM

(71) Applicant: BITZER Kuehlmaschinenbau GmbH, Sindelfingen (DE)

(72) Inventors: Christian Scharer, Gaggenau (DE); Thomas Varga, Aidlingen (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 328 days.

(21) Appl. No.: 16/013,036

(22) Filed: Jun. 20, 2018

(65) Prior Publication Data

US 2018/0298905 A1 Oct. 18, 2018

Related U.S. Application Data

(63) Continuation of application No. PCT/EP2016/081957, filed on Dec. 20, 2016.

(30) Foreign Application Priority Data

Dec. 21, 2015 (DE) ..... 10 2015 122 443.7

(51) Int. Cl.
*F04B 39/02* (2006.01)
*F04C 29/02* (2006.01)
(Continued)

(52) U.S. Cl.
CPC ..... *F04C 29/021* (2013.01); *F04B 39/02* (2013.01); *F04B 39/0207* (2013.01);
(Continued)

(58) Field of Classification Search
CPC ..... F04C 29/021; F04C 23/00; F04C 23/001; F04C 28/02; F04B 39/02; F04B 39/0207;
(Continued)

(56) References Cited

U.S. PATENT DOCUMENTS 3,140,041 A 7/1964 Kramer et al.
6,082,972 A * 7/2000 Moore, Jr. ..... G01F 23/02 417/53
(Continued)

FOREIGN PATENT DOCUMENTS

DE 1 215 182 B 4/1966
DE 10 2013 007887 A1 12/2013
(Continued)

OTHER PUBLICATIONS

English translation of JP05272477 by EPO May 4, 2020.*
English translation of JP02163491 by EPO May 4, 2020.*

*Primary Examiner* — Deming Wan
(74) *Attorney, Agent, or Firm* — Reinhart Boerner Van Deuren P.C.

(57) ABSTRACT

Refrigerant compressor installation comprising at least three compressors which are arranged in parallel between an intake conduit and a pressure conduit and which each comprise a lubricant sump unit, wherein the compressors, when in operation, work in such a way that the respective pressures in the respective lubricant sump units of the respective compressors form a pressure cascade according to which the compressors have a successively slightly decreasing pressure in the respective lubricant sump unit in a defined cascade sequence, and wherein the lubricant sump units are connected to each other in a manner corresponding to the cascade sequence by way of a lubricant conduit system for lubricant transport, and wherein each lubricant sump unit comprises a port to which is connected an insert element which on the one hand establishes communication with the lubricant conduit system and on the other hand is configured such that it predetermines, for the respective
(Continued)

lubricant sump unit, a lubricant level from which lubricant is transported to the lubricant sump unit that follows next in the cascade sequence.

19 Claims, 8 Drawing Sheets

(51) Int. Cl.

| | |
|---|---|
| ***F04B 41/06*** | (2006.01) |
| ***F04B 23/04*** | (2006.01) |
| ***F04B 23/00*** | (2006.01) |
| ***F04B 53/18*** | (2006.01) |
| ***F25B 1/10*** | (2006.01) |
| ***F04C 28/02*** | (2006.01) |
| ***F04C 23/00*** | (2006.01) |
| ***F04C 18/02*** | (2006.01) |

(52) U.S. Cl.
CPC ..... *F04B 39/0246* (2013.01); *F04B 41/06* (2013.01); *F04C 18/0215* (2013.01); *F04C 23/00* (2013.01); *F04C 23/001* (2013.01); *F04C 23/008* (2013.01); *F04C 29/025* (2013.01); *F04C 2240/70* (2013.01); *F04C 2240/809* (2013.01)

(58) Field of Classification Search
CPC ..... F04B 39/0246; F04B 23/04; F04B 23/08; F04B 53/18; F25B 81/10; F16N 19/006
See application file for complete search history.

(56) References Cited

U.S. PATENT DOCUMENTS

| | | | | |
|---|---|---|---|---|
| 9,939,179 | B2 | 4/2018 | Fraser | |
| 2013/0330210 | A1 | 12/2013 | Bonnefoi et al. | |
| 2014/0056725 | A1 | 2/2014 | Fraser et al. | |
| 2014/0154105 | A1 | 6/2014 | Xu et al. | |
| 2014/0241926 | A1 | 8/2014 | Fraser | |
| 2017/0159976 | A1 | 6/2017 | Fraser | |
| 2017/0268513 | A1* | 9/2017 | Schaefer | F04B 39/121 |

FOREIGN PATENT DOCUMENTS

| | | | | | |
|---|---|---|---|---|---|
| DE | 10 2013 113034 | A1 | | 6/2014 | |
| JP | 02163491 | A | * | 6/1990 | F04C 23/00 |
| JP | 05272477 | A | * | 10/1993 | F04C 23/00 |
| JP | 2001 132645 | A | | 5/2001 | |

* cited by examiner

REFRIGERANT COMPRESSOR SYSTEM

CROSS-REFERENCE TO RELATED PATENT APPLICATIONS

This patent application claims the benefit of international application No. PCT/EP2016/081957 filed Dec. 20, 2016.

This patent application claims the benefit of international application No. PCT/EP2016/081957 filed Dec. 20, 2016 and German application No. 10 2015 122 443.7 filed Dec. 21, 2015, the teachings and disclosure of which are hereby incorporated in their entirety by reference thereto.

BACKGROUND OF THE INVENTION

The invention relates to a refrigerant compressor installation comprising at least three compressors which are arranged in parallel between an intake conduit and a pressure conduit and which each comprise a lubricant sump unit.

There is a need in such refrigerant compressor installations to provide sufficient lubricant supply to all of the compressors.

SUMMARY OF THE INVENTION

In accordance with the invention, this object is achieved in a refrigerant compressor installation of the type described at the outset in that the compressors, when in operation, work in such a way that the respective pressures in the respective lubricant sump units of the respective compressors form a pressure cascade according to which the compressors have a successively slightly decreasing pressure in the respective lubricant sump unit in a defined cascade sequence, and in that the lubricant sump units are connected to each other in a manner corresponding to the cascade sequence by way of a lubricant conduit system for lubricant transport, and in that each lubricant sump unit comprises a port to which is connected an insert element which on the one hand establishes communication with the lubricant conduit system and on the other hand is configured such that it predetermines, for the respective lubricant sump unit, a lubricant level from which lubricant is transported to the lubricant sump unit that follows next in the cascade sequence.

The advantage of the solution in accordance with the invention is seen in particular in that it affords the possibility of ensuring, on the basis of the pressure cascade that occurs in the cascade sequence, sufficient supply of lubricant to all of the lubricant sump units, wherein it is ensured, by the predetermined lubricant level, that a sufficient amount of lubricant is present in the individual lubricant sump units.

For determining the predetermined lubricant level, it is preferably provided for each insert element to have a mouth opening of a lubricant channel leading to the lubricant conduit system, which mouth opening is located above the respective predetermined lubricant level in a direction of gravity so that when the amount of lubricant in the respective lubricant sump unit exceeds the predetermined lubricant level, the lubricant can enter the lubricant conduit system via said mouth opening and said lubricant channel in order to flow to the lubricant sump unit that follows next in the cascade sequence.

It is further advantageous, in particular where the lubricant sump unit is to be configured such that it has supplied thereto lubricant from another lubricant sump unit, for the insert elements of the compressors which are in each case located between two compressors in the cascade sequence to have a mouth opening of a lubricant channel leading to the lubricant conduit system, which mouth opening is located below the predetermined lubricant level in a direction of gravity, wherein said lubricant channel and said mouth opening afford the possibility of supplying lubricant to the corresponding lubricant sump unit, which lubricant comes from a preceding lubricant sump unit in the cascade sequence.

Advantageously, provision is made for the mouth opening located above the predetermined lubricant level in a direction of gravity and the mouth opening located below the predetermined lubricant level in a direction of gravity to be arranged in spaced relation to one another in a direction parallel to the direction of gravity.

In order to be able to detect the lubricant level of the respective lubricant sump unit for maintenance and monitoring purposes, provision is made, for example, for a sensor with which the lubricant level can be detected.

Preferably, provision is made for each insert element to comprise a visualization unit for visualizing the lubricant level of the respective lubricant sump unit.

The visualization unit is for example configured such that it provides an image indicating the lubricant level, said image being generated, for example, by electronic or optical imaging.

In particular, for the sake of simplicity of the solution, it is advantageous for the visualization unit to comprise, adjacent to a lubricant bath of the respective lubricant sump unit that extends into the insert element, a sight glass in which the lubricant level can be viewed.

Furthermore, it is preferably provided for each insert element to comprise a visualization unit for visualizing a flow of lubricant to a further lubricant sump unit.

To this end, it is preferably also provided for the visualization unit to comprise a sight glass which allows viewing a flow of lubricant to the lubricant conduit system.

No details have been given so far as to the configuration of the lubricant conduit system.

In principle, the lubricant conduit system could be configured such that it comprises a lubricant conduit with branches leading to each of the insert elements.

A particularly advantageous solution provides for the lubricant conduit system to comprise connection conduits connecting insert elements succeeding each other in the cascade sequence so that each of the connection conduits interconnects only two successive insert elements.

In this case, it is in particular provided for the connection conduit to in each case connect a lubricant channel of the one insert element having one of the mouth openings to a lubricant channel of the other insert element having one of the mouth openings.

In the case of insert elements which comprise a lubricant channel having a mouth opening located above the predetermined lubricant level in a direction of gravity and a lubricant channel having a mouth opening below the respective predetermined lubricant level in a direction of gravity, provision is made for the connection conduit to establish communication between the lubricant channel having a mouth opening located above the predetermined lubricant level in a direction of gravity and the lubricant channel having a mouth opening located below the respective predetermined lubricant level so that thereby flow into the respective lubricant bath is via the mouth opening located below the respective predetermined lubricant level and flow out of the respective lubricant bath is via the mouth opening located above the predetermined lubricant level, which, in particular, results in that when lubricant is transferred from one lubricant sump unit to the other lubricant sump unit, turbulence in said lubricant is kept as low as possible.

No details have been given so far as to the formation of the pressure cascade in the individual lubricant sump units.

Thus, it is preferably provided that the pressure level in the respective lubricant sump unit of the respective compressor is determined by the configuration of the intake conduit.

In particular, an advantageous configuration of the compressors provides for these to be configured such that the pressure in the respective lubricant sump unit is correlated with the suction pressure of the respective compressor.

It is particularly advantageous for the pressure in the respective lubricant sump unit to correspond to the suction pressure of the respective compressor.

The invention can be implemented in a particularly advantageous manner if the port to which the insert element is connected is a standard port for detecting the lubricant level.

No details have been given so far as to the supply to the individual compressors.

Thus, it is preferably provided for the intake conduit system to be configured such that a first compressor in the cascade sequence has the largest amount of lubricant supplied thereto from the intake conduit system, i.e. that the intake conduit system is configured such that lubricant precipitating therein enters the first compressor in the cascade sequence.

Furthermore, it is preferably provided for the intake conduit system to be configured such that the compressors following the first compressor in the cascade sequence receive lesser amounts of lubricant from the intake conduit system.

In particular, provision is made for the intake conduit system to be configured such that the compressors succeeding one another in the cascade sequence in each case receive lesser amounts of lubricant from the intake conduit system in a manner corresponding to their position in the cascade sequence.

No details have been given so far as to the operation of the individual compressors of the refrigerant compressor installation, in particular for the case when individual ones of the compressors are to be shut off.

Thus, it is in particular provided for the refrigerant compressor installation to comprise a controller for the individual compressors which ensures that when individual compressors are shut off, the compressors that are still running are always arranged next to one another in the cascade sequence.

Further features and advantages of the solution in accordance with the invention are the subject of the following description and drawings of a number of exemplary embodiments.

DETAILED DESCRIPTION OF THE INVENTION

Figure 1:
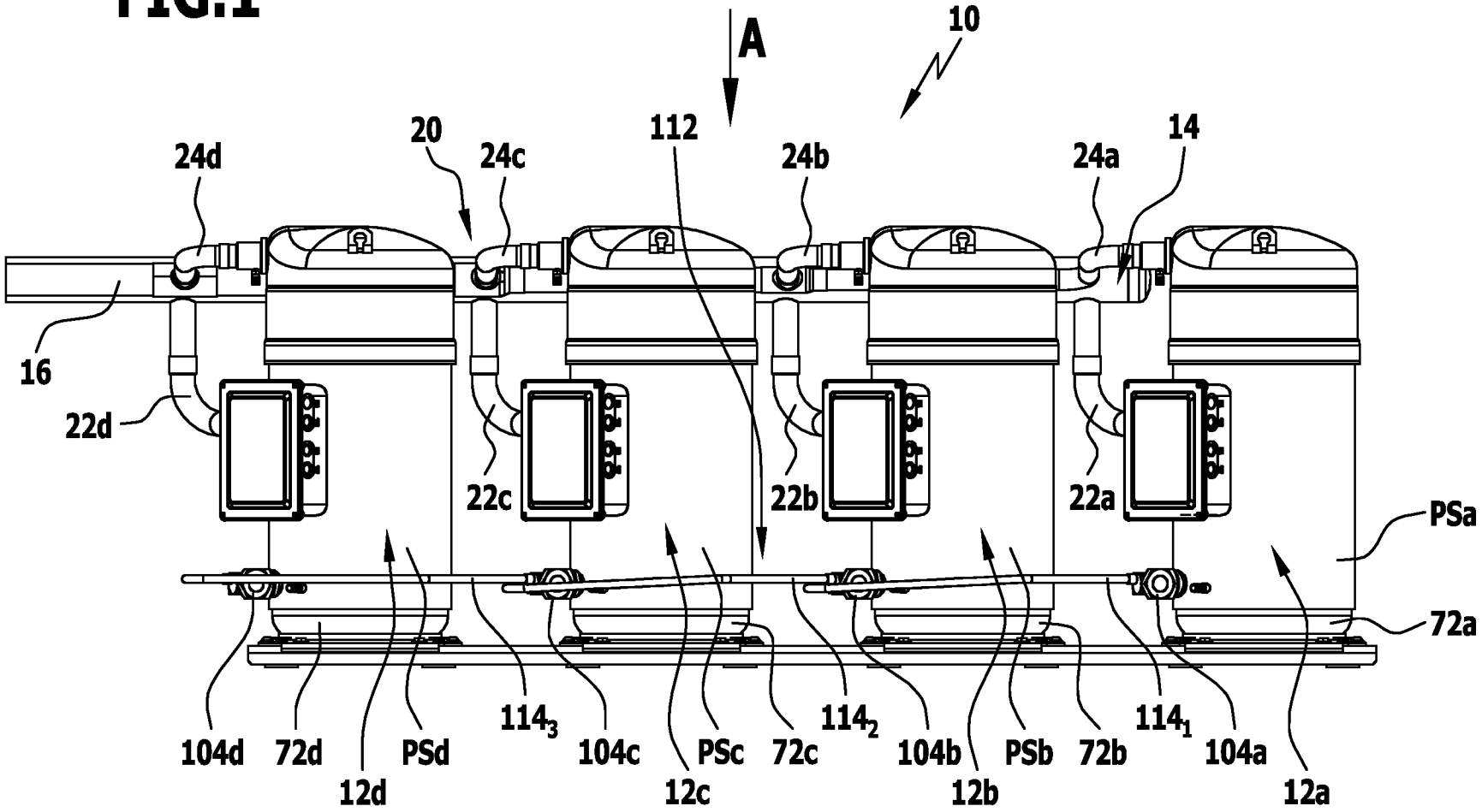
FIG. 1 shows a side view of a refrigerant compressor installation constructed in accordance with the invention.
Figure 2:
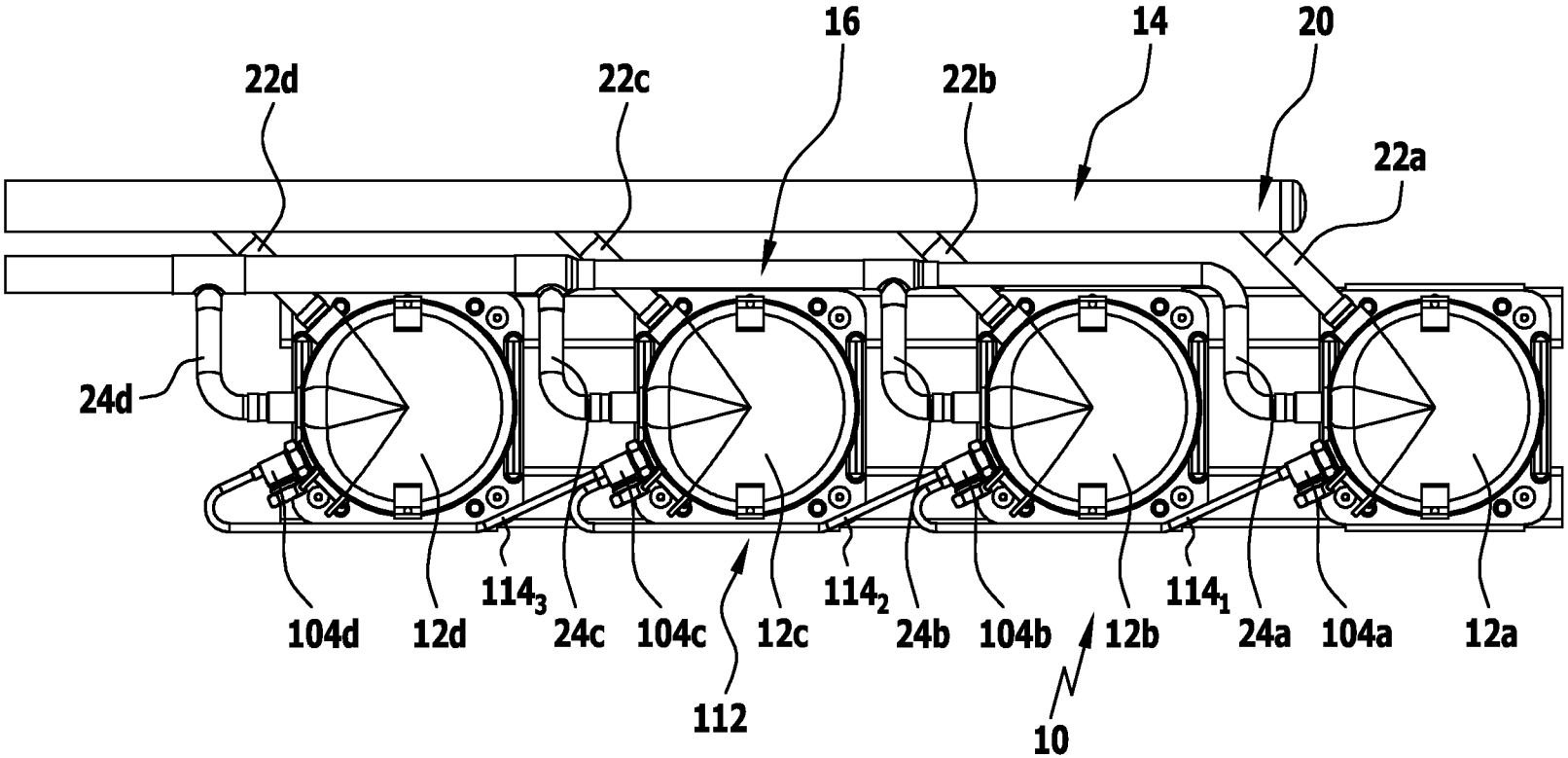
FIG. 2 shows a top view of the refrigerant compressor installation taken in the direction of arrow A in FIG. 1.
Figure 3:
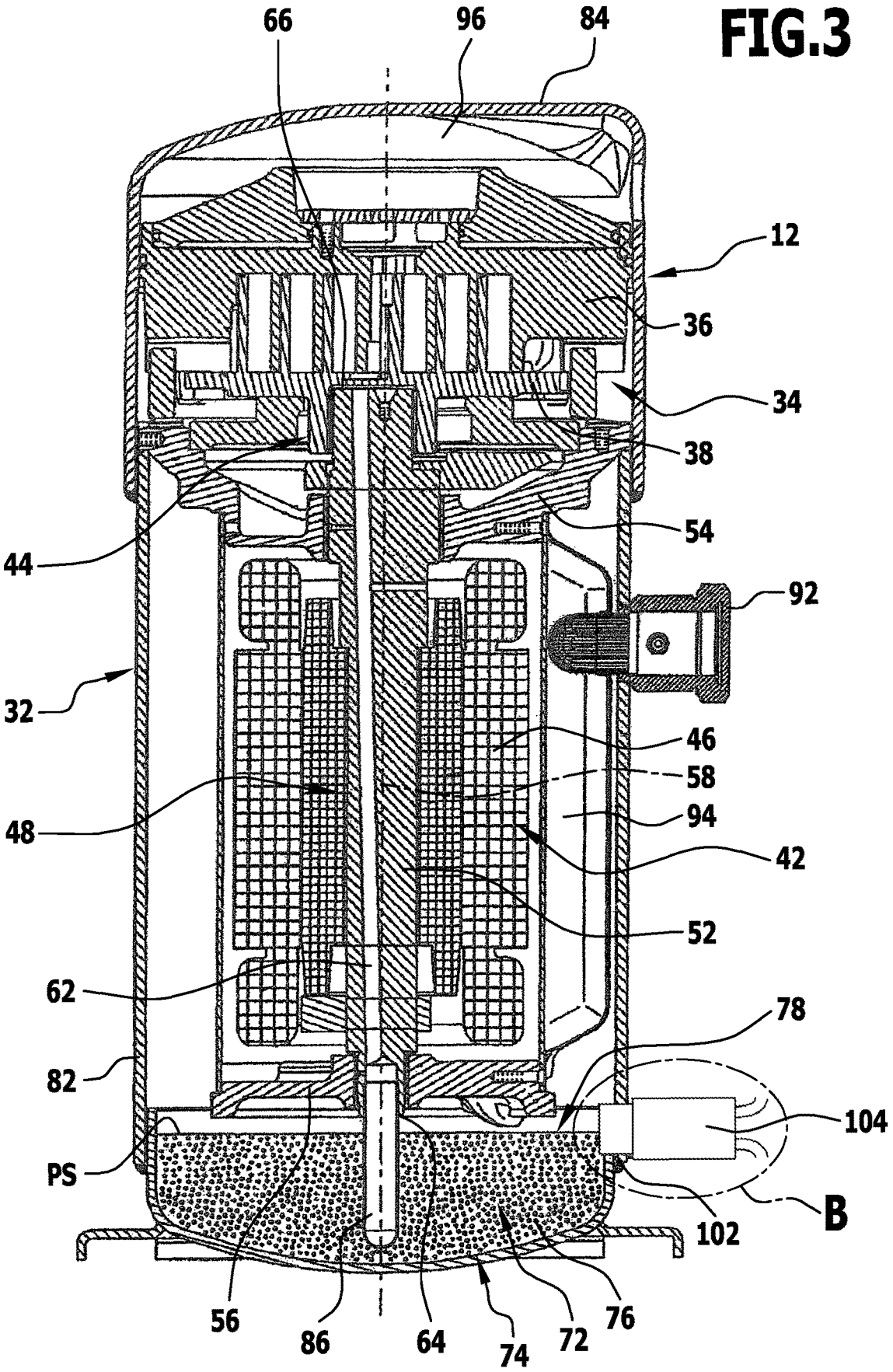
FIG. 3 shows a vertical section taken through an exemplary compressor of the refrigerant compressor installation.

An exemplary embodiment of a refrigerant compressor installation 10, shown in its entirety in FIGS. 1 and 2, comprises a plurality, for example four, compressors 12*a* to 12*d*, which are arranged in parallel between a common intake conduit 14 and a common pressure conduit 16 and which in operation work in parallel, wherein individual suction conduits 22*a* to 22*d* lead from the common intake conduit 14 to the individual compressors 12*a* to 12*d*, said suction conduits 22*a* to 22*d* together with the intake conduit 14 forming an intake conduit system 20.

Furthermore, individual pressure conduits 24*a* to 24*d* lead from the compressors 12*a* to 12*d* to the common pressure conduit 16.

It is preferred for the compressors 12*a* to 12*d* to be of identical configuration, wherein each of said compressors 12 comprises an outer housing 32 in which a compressor unit 34 is provided, for example in the form of a scroll compressor unit having two intermeshing scroll bodies 36 and 38, wherein, for example, the scroll body 36 is arranged in a stationary manner within the outer housing 32, while the scroll body 38 is driven for orbital movement.

For driving the compressor unit 34, a drive motor, generally designated at 42, is provided in the outer housing 32, said drive motor 42 driving the scroll body 38 via an eccentric drive 44.

The drive motor 42, configured as an electric motor, comprises a stator 46 and a rotor 48 which is mounted on a drive shaft 52 which, in turn, is supported in bearing units 54 and 56 for rotation relative to the outer housing 32 about a drive shaft axis 58.

By way of example, the drive shaft 52 is provided with a lubricant channel 62 which extends from a first drive shaft end 64 to a second drive shaft end 66 at a slight angle to the drive shaft axis 58, wherein the second drive shaft end 66 is associated with the eccentric drive 44, whereby the eccentric drive 44 is lubricated via the the lubricant channel 62.

The first drive shaft end 64 faces towards a lubricant sump unit, generally designed at 72, which, as viewed in a direction of gravity, is formed in a low-lying area of the outer housing 32, in the present instance that of a compressor having a substantially vertically extending drive shaft axis 58, by a bowl-shaped bottom body 74 of the outer housing 32, wherein a lubricant bath 76 forms in the bottom body 74, said lubricant bath 76 extending to a bath surface 78 which preferably still lies within the bottom body 74 and whose location in the direction of gravity provides an indication of the level of lubricant.

In particular, the bottom body 74 here represents an endwise closure of a cylindrical shell body 82 of the outer housing 32 which, on the side opposite the bottom body 74, is closed off by a cover body 84.

For drawing lubricant from the lubricant bath 76 into the lubricant channel 62, a suction snout 86 extends from the first drive shaft end 64 of the drive shaft 52 into the lubricant bath 76 so that the suction snout 86 is capable of picking up lubricant from below the bath surface 78 of the lubricant bath 76 and feeding same to the lubricant channel 62, in particular wherein the pumping action that is exerted on the lubricant when the drive shaft 52 is rotated is realized by virtue of the lubricant channel 62 being inclined at an oblique angle to the drive shaft axis 58 and the centrifugal forces generated thereby.

Preferably, the outer housing 32 is provided with a suction port 92 in the area between the compressor unit 34 and the lubricant sump unit 72, said suction port 92 being connected to the corresponding individual suction conduit 22.

The flow of refrigerant entering the outer housing 32 through said suction port 92—said flow of refrigerant also having lubricant entrained therein—enters an intake space 94 surrounding the drive motor 42 and flows in a direction of the compressor unit 34 while simultaneously cooling the drive motor 42, wherein lubricant separates out in the intake space 94 within the outer housing 32, which lubricant then flows in a direction of gravity into the lubricant sump unit 72 and collects in the lubricant bath 76.

This significantly reduces the amount of lubricant in the refrigerant entering the compressor unit 34, and once the lubricant has reached the lubricant bath 76, it is available to lubricate the compressor unit 34, in particular the eccentric drive 44.

The refrigerant that has been compressed in the compressor unit 34 then exits into a pressure space 96 located proximate or adjacent to the cover body 84; from there, the refrigerant then passes through the respective individual pressure conduit 24 and into the common pressure conduit 16.

Based on the separation of the lubricant from the flow of refrigerant in the intake space 94 which is located above the lubricant bath 76, the lubricant in the lubricant sump unit 72 is at a pressure that corresponds to the suction pressure PS of the refrigerant prevailing at the suction port 92 and also substantially corresponds to the suction pressure of the refrigerant drawn in by the compressor unit 34.

By way of example, the lubricant sump unit 72 is, in turn, provided with a port 102 which usually represents a standard port for a sight glass for detecting the lubricant level and which, in the present exemplary embodiment, has inserted therein an insert element, generally designated at 104, which will be described in more detail hereinafter.

The port 102 is arranged at the outer housing 32 such that it is adjacent to the lubricant bath 76 and, in particular, extends on either side of the bath surface 78 at a predetermined lubricant level.

As shown in FIGS. 1 and 2, each of these insert elements 104*a* to 104*d* of the respective compressors 12*a* to 12*d* establishes communication to a lubricant conduit system, generally designated at 112, which comprises connection conduits $\mathbf{114}_1$, $\mathbf{114}_2$, $\mathbf{114}_3$ which run between two insert elements 104 in each case, wherein in the illustrated exemplary embodiment of the refrigerant compressor installation 10 having a total of four compressors 12*a* to 12*d*, the connection conduit $\mathbf{114}_1$ connects the insert elements 104*a* and 104*b*, the connection conduit $\mathbf{114}_2$ connects the insert elements 104*b* and 104*c* and the connection conduit $\mathbf{114}_3$ connects the insert elements 104*c* and 104*d*.

Thus, the lubricant conduit system 112 comprising the connection conduits $\mathbf{114}_1$, $\mathbf{114}_2$, $\mathbf{114}_3$ together with the insert elements 104*a*, 104*b*, 104*c* and 104*d*, as a whole, represents an interconnecting system between the individual lubricant sump units 72 of the individual compressors 12*a*, 12*b*, 12*c* and 12*d* in order to achieve a sufficient distribution of the lubricant via the different lubricant sump units 72, as will be described in greater detail below.

Figure 4:
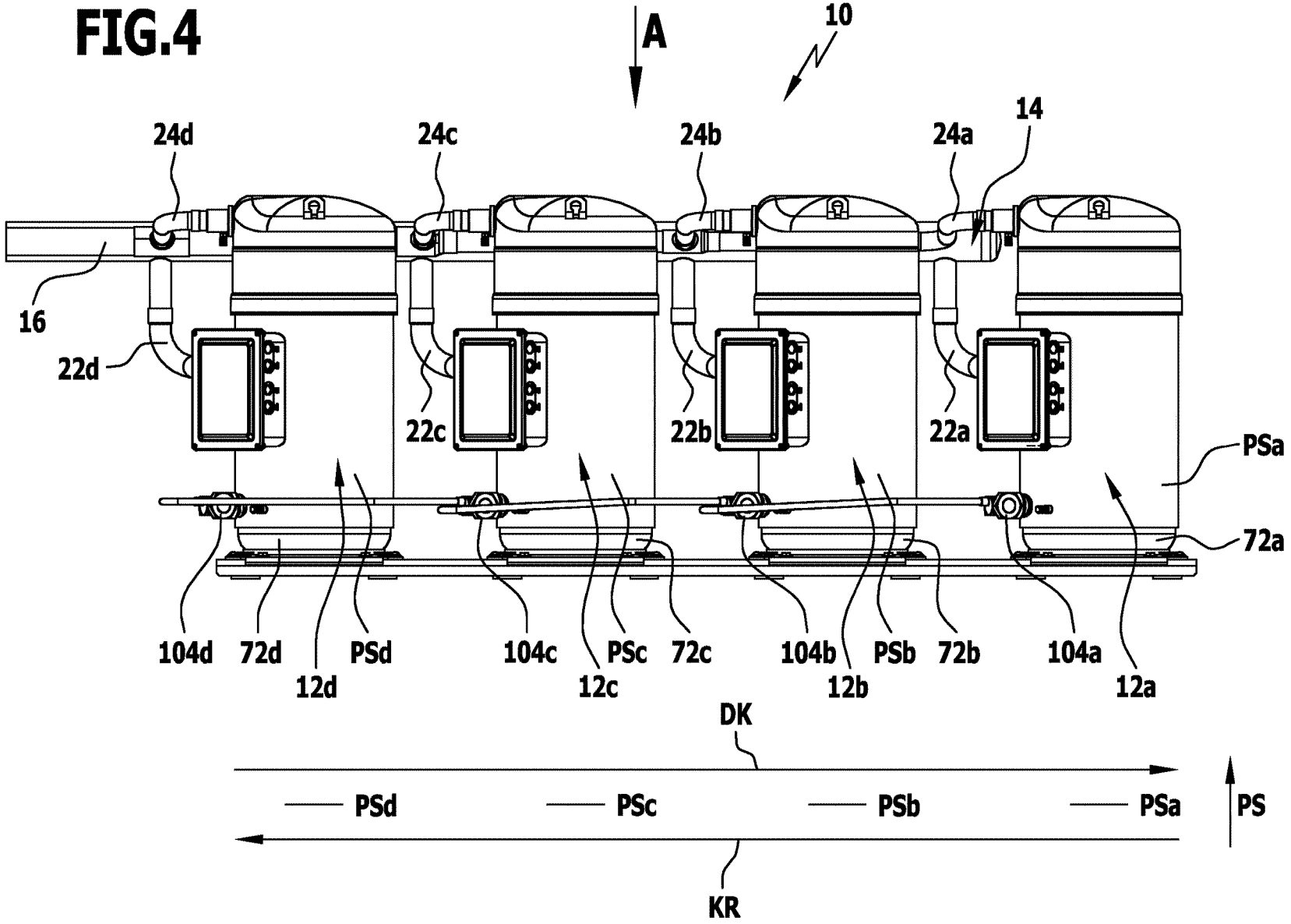
FIG. 4 shows a representation of the refrigerant compressor installation, illustrating the pressure cascade which forms in the individual compressors of the refrigerant compressor installation.

As shown in FIG. 4, in the refrigerant compressor installation 10 in accordance with the invention, the common intake conduit 14 together with the individual suction conduits 22*a* to 22*d* opening thereinto, is configured such that one of the compressors 12, by way of example the compressor 12*a*, has a suction pressure PSa within the outer housing 32 that is greater than the suction pressure PSb in the compressor 12*b*, which in turn is greater than the suction pressure PSc in the compressor 12*c*, wherein said suction pressure PSc is in turn greater than the suction pressure PSd in the compressor 12*d*.

Thus, since the suction pressures PSa, PSb, PSc and PSd correspond to the respective pressures in the respective lubricant sump units 72*a*, 72*b*, 72*c*, 72*d*, the lubricant in the respective lubricant sump units 72*a*, 72*b*, 72*c* and 72*d* is at a different pressure in each case (FIG. 4).

Thus, the pressures PSa, PSb, PSc and PSd together form a pressure cascade DK of successively lesser pressures having a cascade sequence KR which extends from the lubricant sump unit 72*a* to the lubricant sump unit 72*d*.

By way of example, as illustrated in FIG. 4, the pressure PSa is greater than the pressure PSb by an order of magnitude of one or a few tenths of bar, and this is in turn greater than the pressure PSc by one or a few tenths of bar, and the pressure PSc is, in turn, greater than the pressure PSd by one or a few tenths of bar so that the pressure cascade DK is formed in which, in a cascade direction KR, the pressure decreases successively in each case from the one lubricant sump unit 72 to the next following lubricant sump unit 72 in the cascade sequence KR.

The highest pressure level PSa in the compressor 12*a* and hence in the lubricant sump unit 72*a* can be achieved in that said compressor 12*a*, for an intake conduit 14 of constant cross-section from which the compressors 12 draw refrigerant successively, is the last refrigerant-drawing compressor so that the lowest flow velocity of the refrigerant in the intake conduit 14 occurs at the transition to the individual suction conduit 22*a*, while for example the first compressor 12*d* having the individual suction conduit 22*d* draws refrigerant from the common intake conduit 14 from the area where the maximum flow velocity is encountered because the refrigerant drawn by the remaining compressors 12*c*, 12*b* and 12*a* also flows through the intake conduit 14 in the area of the mouth of the individual suction conduit 22*d* so that this is the area where the pressure of the flowing refrigerant is lowest.

Furthermore, the common intake conduit 14 having the individual suction conduits 22*a* to 22*d* is configured such that the compressor 12*a*, which has the highest pressure in the lubricant sump unit 72 in the pressure cascade DK, is the lead compressor which receives the largest amount of lubricant from the common intake conduit 14, while the compressors 12*b*, 12*c* and 12*d* which in each case lie next in the cascade direction KR receive successively lesser amounts of lubricant from the intake conduit 14 so that the last lubricant sump unit 72*d* receives the least amount of lubricant.

This can be achieved in that the lubricant that is already precipitating in the common intake conduit 14 is for the most part supplied to the lead compressor 12*a*, while the amounts of lubricant entering the other compressors 12*b*, 12*c* and 12*d* from the common intake conduit 14 are smaller, wherein to this end the individual suction conduit 22*d* projects farthest into the intake conduit 14 and the individual suction conduits 22*c*, 22*b* and 22*a* project successively less far into the intake conduit 14 so that lubricant precipitating and collecting in the intake conduit 14 primarily enters the individual suction conduit 22*a*.

Figure 6:
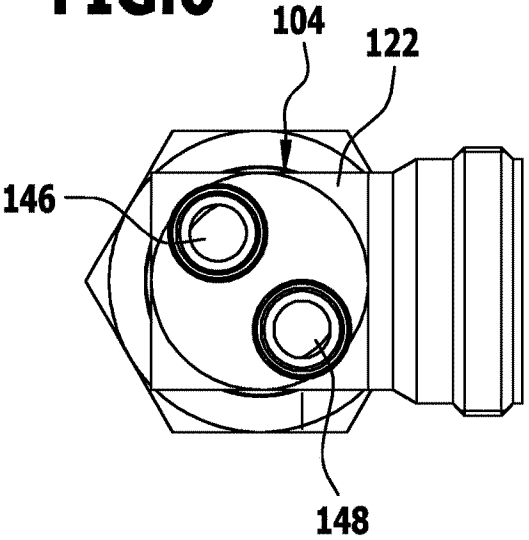
FIG. 6 shows a view of an insert element taken in the direction of arrow C in FIG. 5.
Figure 5:
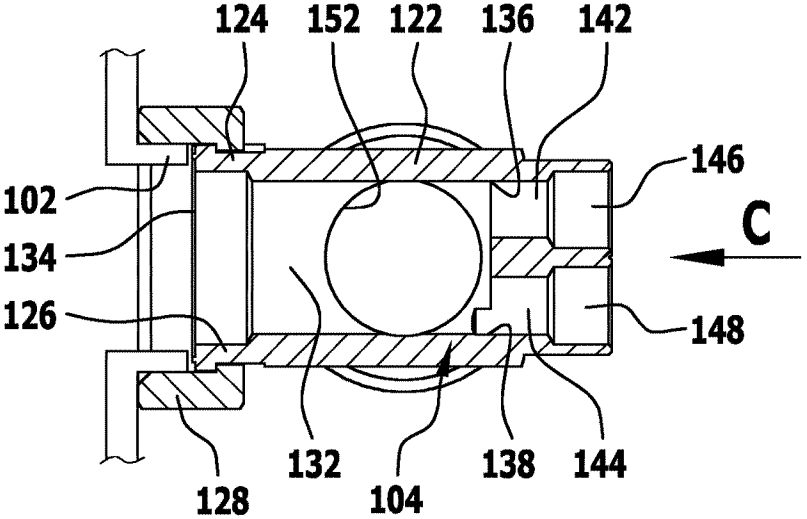
FIG. 5 shows an enlarged view of detail B of FIG. 3.
Figure 7:
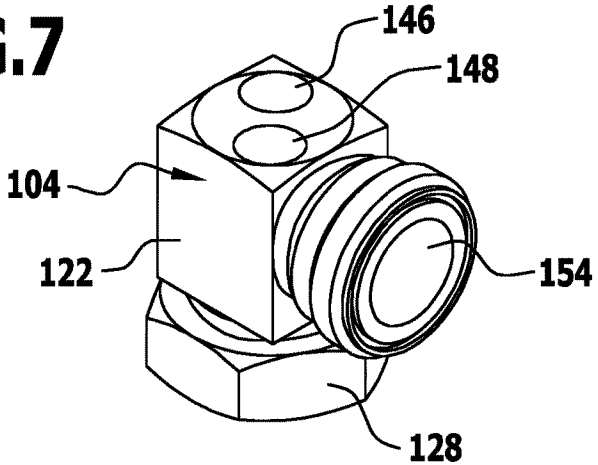
FIG. 7 shows a perspective view of the insert element.

As shown in FIGS. 5 to 7, each of the insert elements 104 comprises a housing body 122 which is provided at a first end 124 thereof with a connection piece 126 which can be connected to the port 102, for example by way of a union nut 128.

Provided within the housing body 122 is an inner space 132 which extends from a lubricant bath opening 134 facing towards the port 102 and communicating with the lubricant bath 76 to mouth openings 136 and 138 of lubricant channels 142 and 144 that are located opposite said lubricant bath opening 134, wherein the lubricant channels 142, 144 lead to ports 146 and 148 respectively for the connection conduits 114.

Furthermore, the inner space 132 is provided with a lateral opening 152 which is closed off with a sight glass 154 for visualizing a lubricant level of the lubricant bath 76 extending into the inner space 132, which lubricant level will be explained in further detail below, so that the sight glass 154 permits a view into the inner space 132, preferably across the entire cross-section thereof in a vertical direction.

In particular, the insert elements 104 in accordance with the invention are connected to the respective lubricant sump unit 72 in such a way that the mouth openings 136 and 138 and hence also the ports 146 and 148 are arranged in spaced relation to each other, one above the other, as viewed in a direction of gravity.

Figure 8:
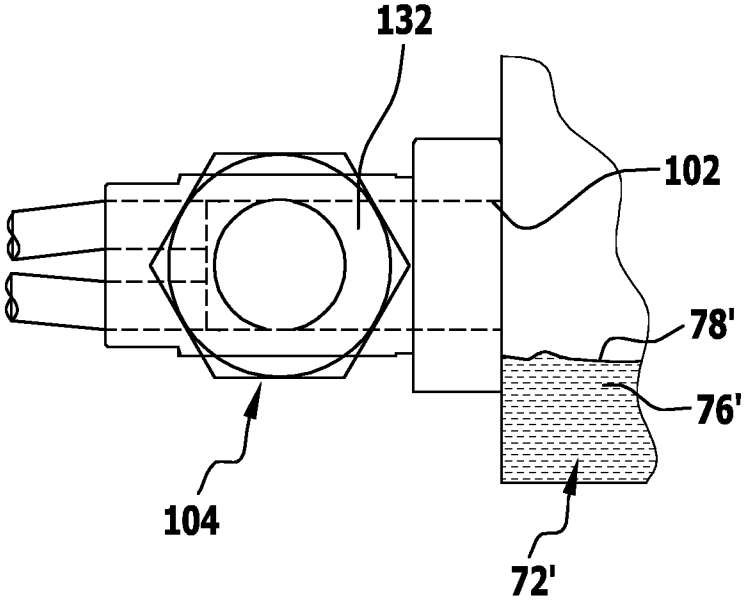
FIG. 8 shows a schematic representation of the insert element in relation to a lubricant bath whose bath surface is at a level below a predetermined lubricant level.

As shown in FIGS. 8 to 11, a small amount of lubricant introduced into the respective compressor 12, as shown for example in FIG. 8, results in a lubricant bath 76' whose bath surface 78' indicating the lubricant level is below the port 102 in a direction of gravity so that lubricant cannot enter the inner space 132 of the insert element 104.

Figure 9:
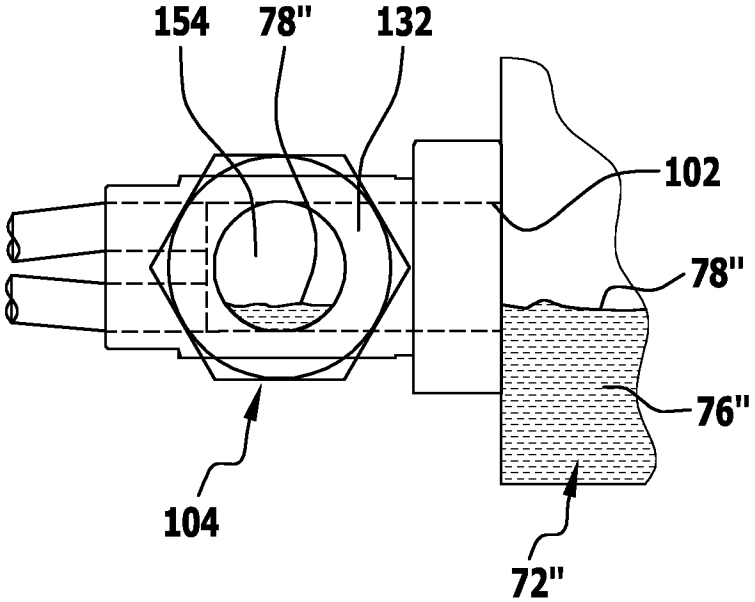
FIG. 9 shows a representation corresponding to FIG. 8, wherein the bath surface of the lubricant bath is at a level high enough for the bath surface to be viewable in a sight glass of the insert element.

However, if the amount of lubricant increases, as shown in FIG. 9, the bath surface 78" of the lubricant bath 76", in this case of the lubricant sump unit 72", is high enough for the bath surface 78" to be also viewable in the sight glass 154, with the lubricant level being already high enough that the lubricant could be admitted into the mouth opening 138.

Figure 10:
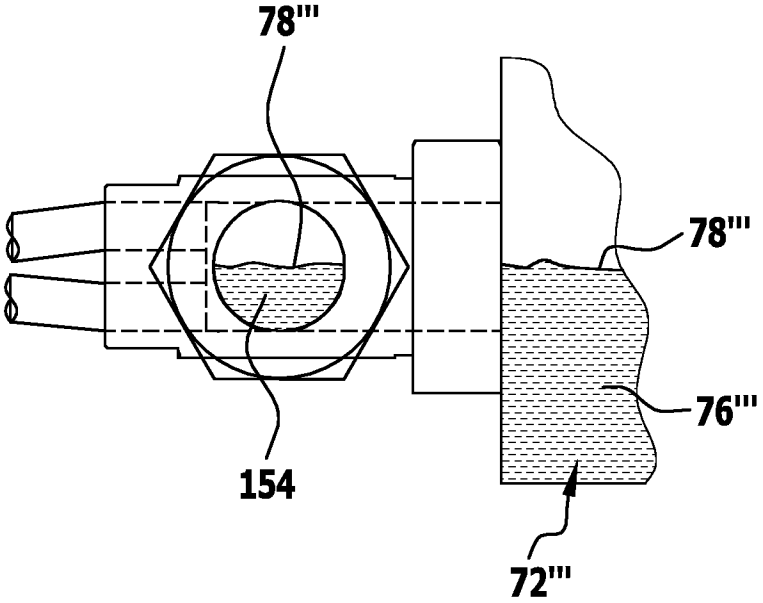
FIG. 10 shows a representation corresponding to FIG. 8, wherein the bath surface of the lubricant bath is shown as having reached the predetermined lubricant level.

As the amount of lubricant continues to increase, as shown by way of example for the case of the lubricant sump unit 72" in FIG. 10, the bath surface 78' of the lubricant bath 76" rises high enough for it to be above the mouth opening 138 and to be also clearly viewable in the sight glass 154.

Figure 11:
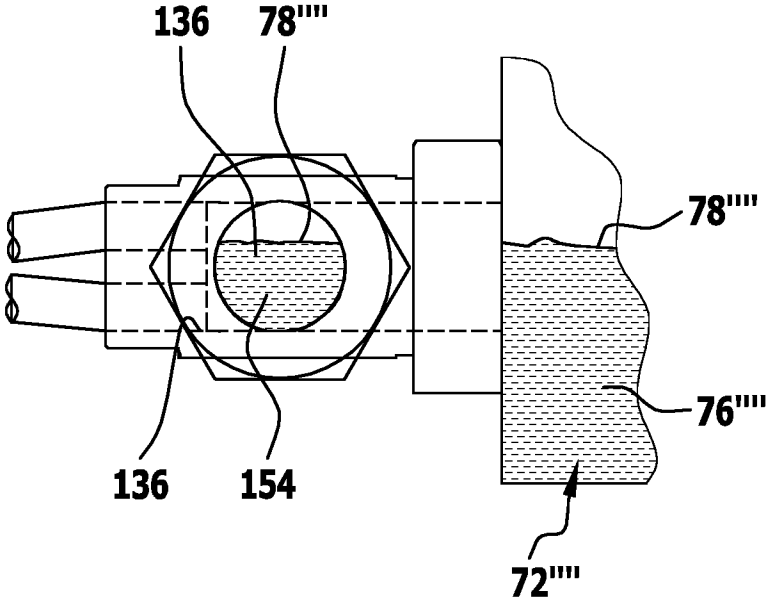
FIG. 11 shows a representation similar to FIG. 8, wherein the bath surface of the lubricant bath is at a level higher than the predetermined lubricant level so that lubricant flows via the insert element into the lubricant conduit system and from the lubricant conduit system into the next-following compressor.

A further increase in the amount of lubricant, as illustrated in FIG. 11 and shown for the case of the lubricant sump unit 72"", results in that the bath surface 78"" of the lubricant bath 76"" is also viewable in the sight glass 154 and lubricant can additionally enter the mouth opening 136.

If now the mouth opening 136 of the lubricant channel 142 is utilized to discharge lubricant from the lubricant bath 76"", then the location of the mouth opening 136 defines the predetermined lubricant level from which lubricant can be transferred from the lubricant bath 76"" to the next lubricant sump unit 72.

Figure 12:
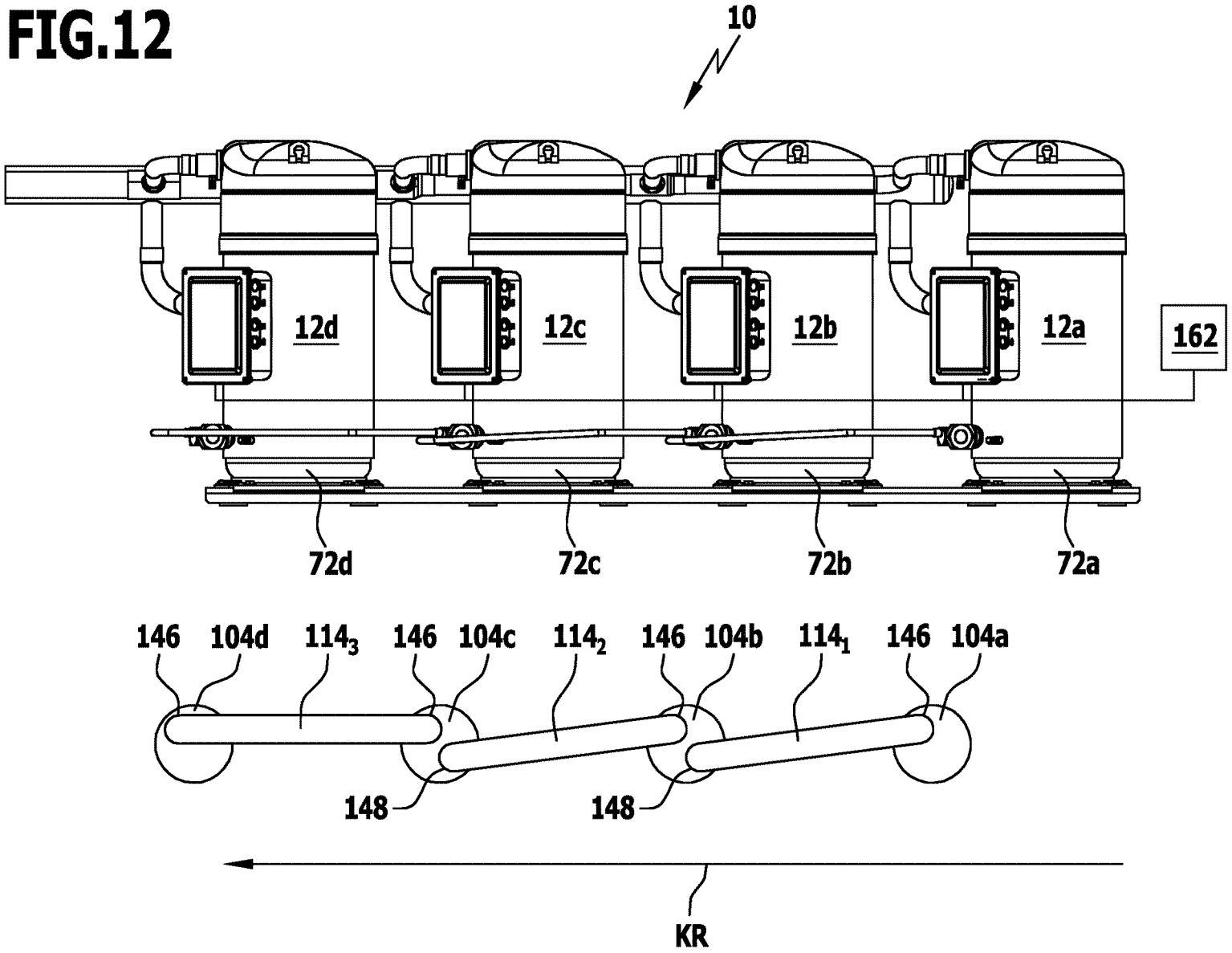
FIG. 12 is a view of the refrigerant compressor installation similar to FIG. 1, representing the individual insert elements and the connecting conduits of the lubricant conduit system between the individual insert elements.

If now, as illustrated in FIG. 12, the insert element 104*a* has the connection conduit $\mathbf{114}_1$ connected to the port 146 which is associated with the first mouth opening 136, lubricant will enter the connection conduit $\mathbf{114}_1$ when the bath surface 78"" is above the mouth opening 136, as it is shown in FIG. 11.

Said lubricant then flows through the connection conduit $\mathbf{114}_1$ to the next-following insert element 104*b*, wherein the connection conduit $\mathbf{114}_1$ is connected to the port 148 of the insert element 104*b*, this being located below the port 146 as viewed in a direction of gravity.

Based on the pressure cascade DK, the pressure difference results in that lubricant passes from the lubricant sump unit 72*a* to the lubricant sump unit 72*b* as long as the bath surface 78"" is not below the mouth opening 136 but is always high enough for lubricant to be permitted to enter the mouth opening 136 and hence the connection conduit $\mathbf{114}_1$.

However, if, as illustrated in FIGS. 8, 9 and 10 by way of example, the bath surface 78',78", 78'" is below the mouth opening 136, refrigerant alone flows through the connection conduit $\mathbf{114}_1$ into the lubricant sump unit 72*b*, based on the pressure differential existing through the pressure cascade DK.

Since the lead compressor 12*a* receives the greatest amount of lubricant from the intake conduit 14, after a finite running time of the refrigerant compressor installation has elapsed, the lubricant bath 76 of the lubricant sump unit 72 will also have a bath surface 78' which is at a level high enough for lubricant in the insert element 104*b* to be allowed to enter the mouth opening 136 and hence routed from the connection conduit $\mathbf{114}_2$ to the insert element 104*c* and also for the lubricant to enter the lubricant bath 76 of the lubricant sump unit 72*c* via the mouth opening 138.

In the lubricant sump unit 72*c*, the lubricant bath 76 is also topped up until the bath surface 78 is likewise at a level high enough for the lubricant to be allowed to enter the mouth opening 136 of the insert element 104*c* and to be supplied to the insert element 104*d* by way of the connection conduit $\mathbf{114}_3$.

For simplicity, the first insert element 104*a* and the last insert element 104*d* in the cascade sequence KR are in each case configured such that in these the mouth opening 138, the lubricant channel 144 and the port 148 either do not exist or are closed off because said insert elements 104*a* and 104*d* only require the mouth opening 136, the lubricant channel 142 and the port 146; this is because it is irrelevant for the last lubricant sump unit 72*d* in the cascade sequence KR whether the supplied lubricant enters the lubricant bath 76 via the mouth opening 136 or the mouth opening 138.

As shown in FIG. 12, a compressor controller 162 is provided for controlling the individual compressors 12*a*, 12*b*, 12*c* and 12*d* of the refrigerant compressor installation 10, which compressor controller 162 provides that, where individual compressors 12 are shut off, the remaining running compressors are located next to one another in the cascade sequence KR so that it is always possible for lubricant to be allowed to pass from a lubricant sump unit 72 at a higher pressure level in the pressure cascade DK to a lubricant sump unit 72 that follows next in the cascade sequence KR so that a sufficient amount of lubricant is always supplied to the running compressors.

It is particularly advantageous if the compressor controller 162 operates in such a way that, where individual compressors 12 are shut off, these are shut off in a reverse direction from the cascade direction KR so that, for example, when one compressor is shut off, it is the compressor 12*d* that is shut off, and when another compressor is shut off, it is the compressor 12*c* that is shut off, and so on, so that the lead compressor 12*a* is always the last running compressor and the excess lubricant in the lubricant sump unit 72*a* of said lead compressor 12*a* is still transferred to the compressor 12 that follows next in the cascade sequence KR.

The invention claimed is:

1. Refrigerant compressor installation, comprising at least three compressors which are arranged in parallel between an intake conduit and a pressure conduit and which each comprises a lubricant sump unit, the compressors, when in operation, work in such a way that the respective pressures in the respective lubricant sump units of the respective compressors form a pressure cascade according to which the compressors have a successively slightly decreasing pressure in the respective lubricant sump unit in a defined cascade sequence, the lubricant sump units are connected to each other in a manner corresponding to the cascade sequence by way of a lubricant conduit system for lubricant transport, and each of the lubricant sump units comprise a port to which is connected an insert element which on the one hand establishes communication with the lubricant conduit system and on the other hand is configured such that it predetermines, for the respective lubricant sump unit, a lubricant level from which lubricant is transported to the lubricant sump unit that follows next in the cascade sequence.

2. The refrigerant compressor installation in accordance with claim 1, wherein each of the insert elements has a first mouth opening of a lubricant channel leading to the lubricant conduit system, the first mouth opening being located above the respective predetermined lubricant level in a direction of gravity.

3. The refrigerant compressor installation in accordance with claim 2, wherein the insert elements of the compressors which are in each case located between two of the at least three compressors in the cascade sequence have a second mouth opening of the lubricant channel leading to the lubricant conduit system, the second mouth opening being located below the predetermined lubricant level in a direction of gravity.

4. The refrigerant compressor installation in accordance with claim 3, wherein the first mouth opening located above the predetermined lubricant level in a direction of gravity and the second mouth opening located below the predetermined lubricant level in a direction of gravity are arranged in spaced relation to one another in a direction parallel to the direction of gravity.

5. The refrigerant compressor installation in accordance with claim 1, wherein each of the insert elements comprise a visualization unit for visualizing the lubricant level in the respective lubricant sump unit.

6. The refrigerant compressor installation in accordance with claim 5, wherein the visualization unit comprises, adjacent to a lubricant bath of the respective lubricant sump unit that extends into the insert element, a sight glass in which the lubricant level is viewable.

7. Refrigerant compressor installation in accordance with claim 1, wherein each of the insert elements comprise a visualization unit for visualizing a flow of lubricant to the respective lubricant sump unit.

8. The refrigerant compressor installation in accordance with claim 7, wherein the visualization unit comprises a sight glass which allows viewing a flow of lubricant to the lubricant conduit system.

9. The refrigerant compressor installation in accordance with claim 1, wherein the lubricant conduit system comprises connection conduits connecting the insert elements of the successive lubricant sump units in the cascade sequence.

10. The refrigerant compressor installation in accordance with claim 9, wherein the connection conduit in each case connects a lubricant channel of the one insert element having one of mouth openings to a lubricant channel of the other insert element having one of mouth openings.

11. The refrigerant compressor installation in accordance with claim 9, wherein the connection conduit establishes communication between a lubricant channel having a first mouth opening located above the predetermined lubricant level in a direction of gravity and the lubricant channel having a second mouth opening located below the respective predetermined lubricant level in a direction of gravity.

12. The refrigerant compressor installation in accordance with claim 1, wherein the pressure level in the respective lubricant sump unit of the respective compressor is determined by the configuration of the intake conduit.

13. The refrigerant compressor installation in accordance with claim 1, wherein the compressors are configured such that the pressure in the respective lubricant sump unit is correlated with the suction pressure of the respective compressor.

14. The refrigerant compressor installation in accordance with claim 13, wherein the pressure in the respective lubricant sump unit corresponds to the suction pressure of the respective compressor.

15. The refrigerant compressor installation in accordance with claim 1, wherein the port to which the insert element is connected is a port for a sight glass for detecting the lubricant level.

16. The refrigerant compressor installation in accordance with claim 1, wherein the intake conduit is configured such that a first compressor in the cascade sequence has the largest amount of lubricant supplied thereto from the intake conduit system.

17. The refrigerant compressor installation in accordance with claim 16, wherein the intake conduit is configured such that the compressors following the first compressor in the cascade sequence receive lesser amounts of lubricant from the intake conduit.

18. The refrigerant compressor installation in accordance with claim 17, wherein the intake conduit is configured such that the compressors succeeding one another in the cascade sequence in each case receive lesser amounts of lubricant from the intake conduit in a manner corresponding to their position in the cascade sequence.

19. The refrigerant compressor installation in accordance with claim 1, wherein the refrigerant compressor installation comprises a controller for each of the individual compressors which ensures that when any one of the individual compressors is shut off, the compressors that are still running are always arranged next to one another in the cascade sequence.

* * * * *